US006313735B1

(12) United States Patent
Higuchi

(10) Patent No.: US 6,313,735 B1
(45) **Date of Patent: *Nov. 6, 2001**

(54) RADIO SELECTIVE CALLING RECEIVER

(75) Inventor: Norihiko Higuchi, Shizuoka (JP)

(73) Assignee: NEC Corporation, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/175,274

(22) Filed: Oct. 20, 1998

(30) Foreign Application Priority Data

Oct. 27, 1997 (JP) ..... 9-294578

(51) Int. Cl.[7] ..... G08B 23/00

(52) U.S. Cl. ..... 340/7.54; 340/825.49; 340/7.55; 379/88.05

(58) Field of Search ..... 340/825.44, 825.52, 340/825.47, 7.27, 5.28, 7.2, 7.33, 7.55, 7.56, 7.54, 825.49; 701/207, 213; 455/440, 456; 342/357.09; 379/88.05, 88.06, 142.1

(56) References Cited

U.S. PATENT DOCUMENTS 4,870,402 * 9/1989 DeLuca et al. ..... 340/825.44
5,889,473 * 3/1999 Wicks ..... 340/825.44

* cited by examiner

*Primary Examiner*—Michael Horabik
*Assistant Examiner*—William Bangachon
(74) *Attorney, Agent, or Firm*—Scully, Scott, Murphy & Presser

(57) ABSTRACT

In order to provide a radio selective calling receiver that can display a message in language at the current location without making a user recognize the current location, character fonts are automatically switched on the basis of the area information contained in a reception signal.

9 Claims, 15 Drawing Sheets

FIG. 13

| AREA INFORMATION | AREA | LANGUAGE | FONT TABLE |
|---|---|---|---|
| 01 | U.S.A. | ENGLISH | 01 |
| 02 | FRANCE | FRENCH | 02 |
| 03 | GERMAN | GERMANY | 03 |
| 04 | ENGLAND | ENGLISH | 01 |
| 05 | RUSSIA | RUSSIAN | 04 |
| 06 | SPAIN | SPANISH | 05 |
| ·<br>· | ·<br>· | ·<br>· | ·<br>· |

RADIO SELECTIVE CALLING RECEIVER

BACKGROUND OF THE INVENTION

1. Field of the Invention

The present invention relates to a radio selective calling receiver and, more particularly, to a radio selective calling receiver having the function of displaying a message in language corresponding to the current location.

2. Description of the Prior Art

A conventional radio selective calling receiver (to be abbreviated as a receiver hereinafter) will be described with reference to FIG. 1. Referring to FIG. 1, reference numeral 1 denotes an antenna; 2, a radio section; 3, control section; 4, an individual number storage section; 5, a speaker; 6, a vibration motor; 7, an LED; 8, a display section; 9, a character font storage section; and 10, a font table designation storage section.

In this receiver, a signal received through the antenna 1 is amplified and demodulated by the radio section 2 and decoded by the control section 3. The control section 3 compares the call number contained in the decoded signal with the self-call number written in the individual number storage section 4. If they coincide with each other, the control section 3 loads the data and performs data processing. Character data corresponding to a plurality of languages are stored as font tables in the character font storage section 9.

Data indicating a specific one of the font tables which is to be used to display a message is set in the font table designation storage section 10.

Note that the set data in the font table designation storage section 10 can be rewritten externally.

After the loaded data is processed, the speaker 5, the vibration motor 6, and the LED 7 are driven to inform the reception of the incoming call. At the same time, the processed message is converted into font table characters set in the font table designation storage section 10, and the characters are displayed on the display section 8.

In the above method, however, when the designation of the font table to be used for display is to be changed, the new designated font table must be input. For this reason, it takes much time and effort to change the character font to be used for display, presenting a challenge to solve this problem.

SUMMARY OF THE INVENTION

The present invention has been made in consideration of the above situation, and has as its object to provide a radio selective calling receiver which can receive a message in a language corresponding to the current location without making a user recognize the current location.

According to the present invention, there is provided a radio selective calling receiver comprising:

current location determining means for determining a current location from a reception signal;

a character font storage section storing character fonts for a plurality of languages;

an area-language correspondence storage section for storing a correspondence between areas and languages;

character font selection means for selecting a character font for a language corresponding to the current location on the basis of data stored in the area-language correspondence storage section; and display means for displaying a message by using the character font selected by the character font selecting means.

According to the present invention, the current location determining section determines a current location by detecting area information from system information of a currently received signal.

According to the present invention, a user can arbitrarily set the character font selection means to use or not to use a selection function of the character font selection means.

BRIEF DESCRIPTION OF THE DRAWINGS

FIG. 13 is a view showing the stored contents of an area-language correspondence storage section 11 in FIG. 2;

DETAILED DESCRIPTION OF THE PREFERRED EMBODIMENTS

Figure 2:
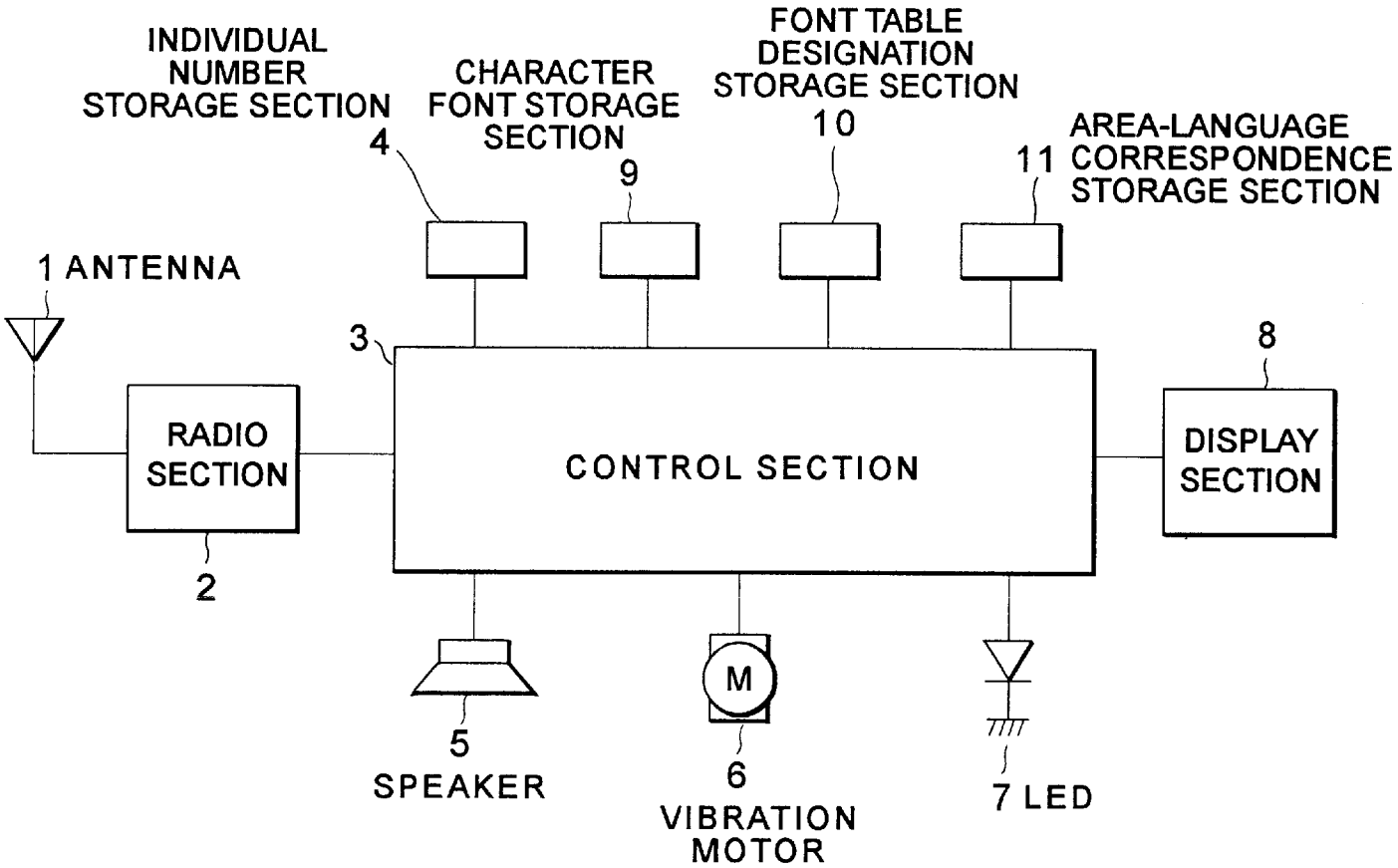
FIG. 2 is a block diagram showing the arrangement of a radio selective calling receiver according to an embodiment of the present invention.

An embodiment of the present invention will be described below with reference to the accompanying drawings. FIG. 2 is a block diagram showing the arrangement of a radio selective calling receiver having a notification information changing capability according to an embodiment of the present invention.

The notification information changing capability refers to the capability of the paging receiver to, on the basis of location information data in a received radio pager signal, display a message in the received radio pager signal in any one of several alternative languages in dependence upon the location information data.

Figure 3:
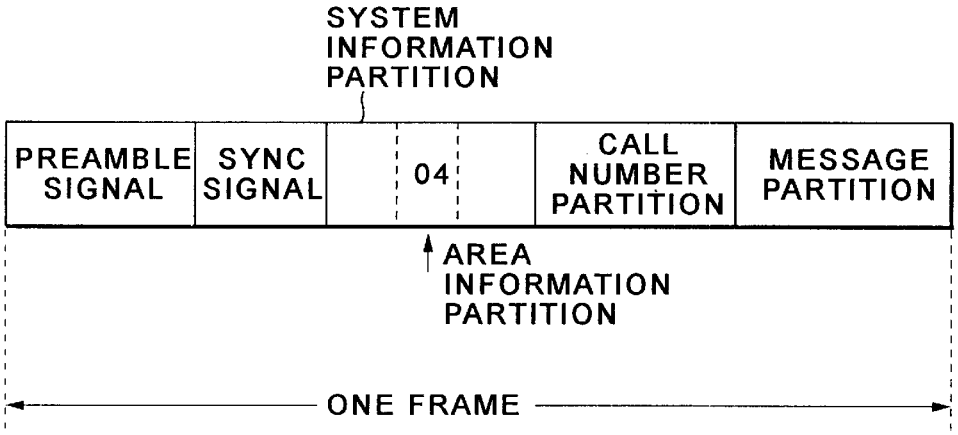
FIG. 3 is a view showing the format of a reception signal in the radio selective calling receiver.
Figure 4:
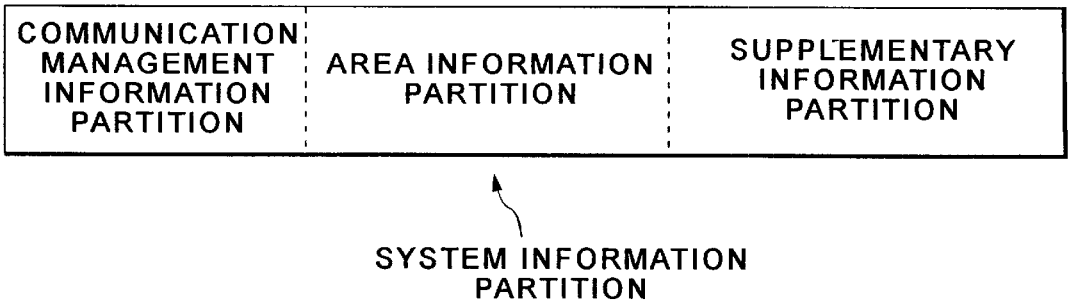
FIG. 4 is a view showing the format of the system information partition of the signal in FIG. 3.
Figure 5:
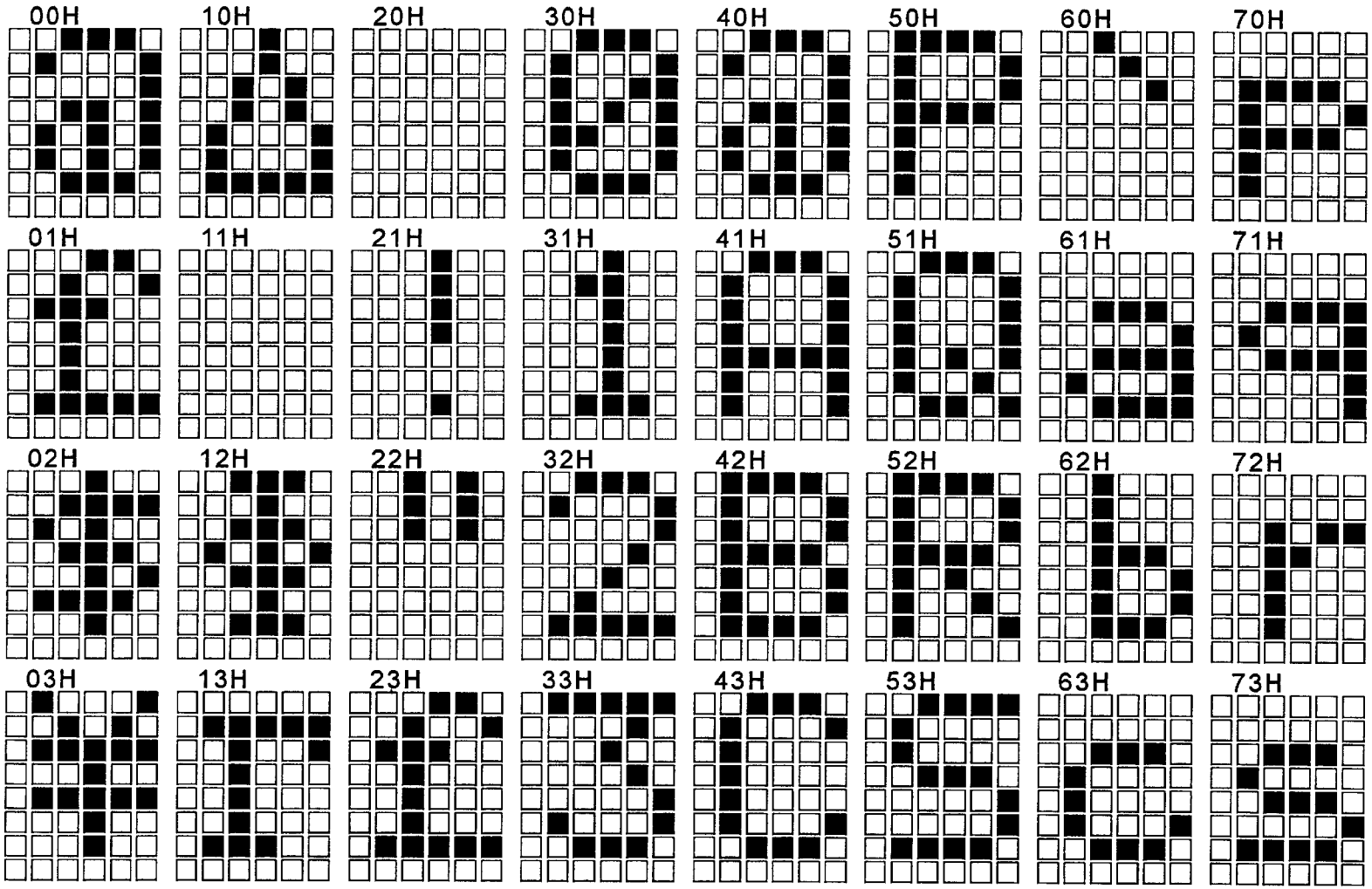
FIGS. 5 to 12 are views showing font tables stored in a character font storage section 9 in FIG. 2.
Figure 6:
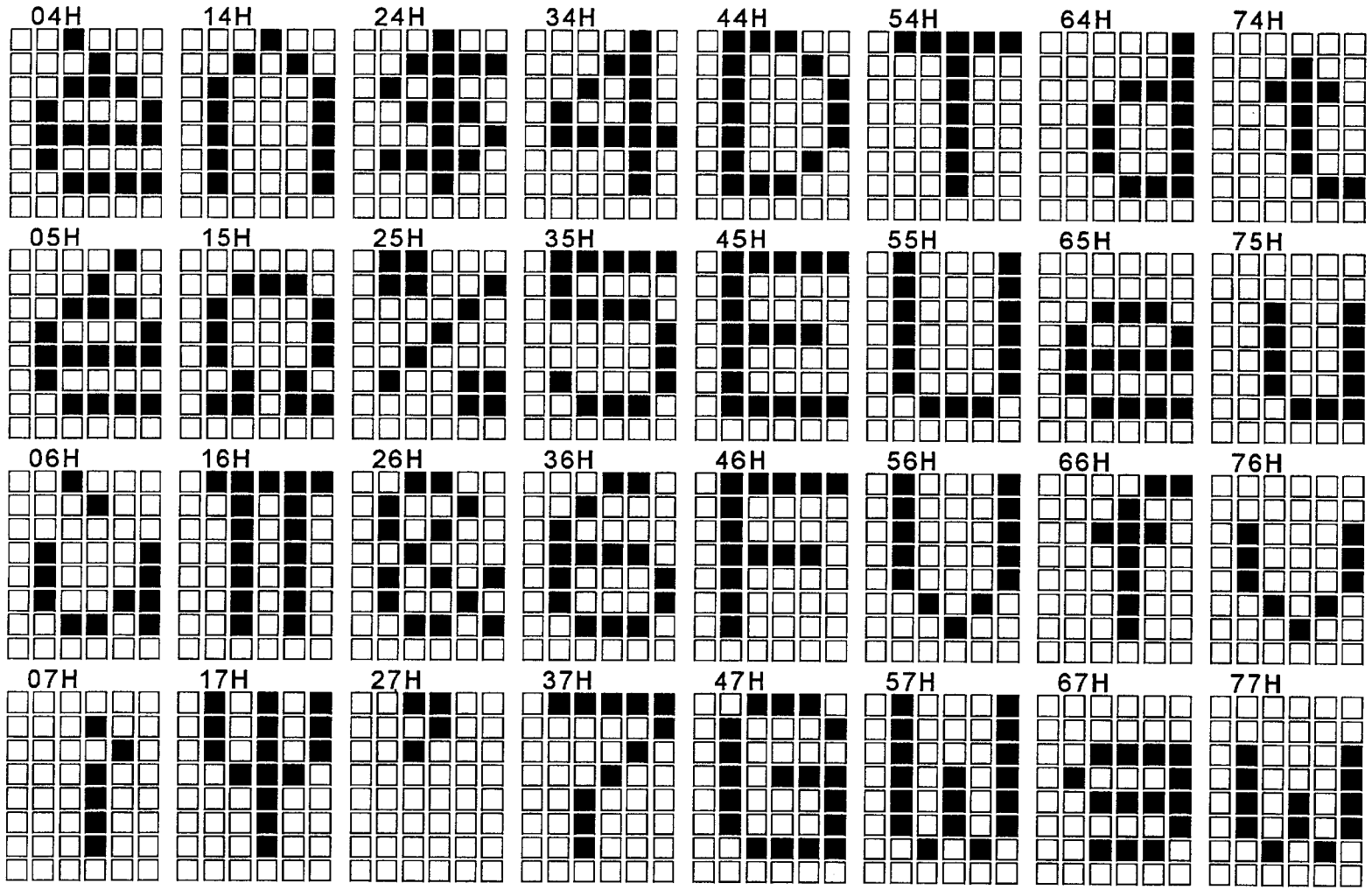
Figure 7:
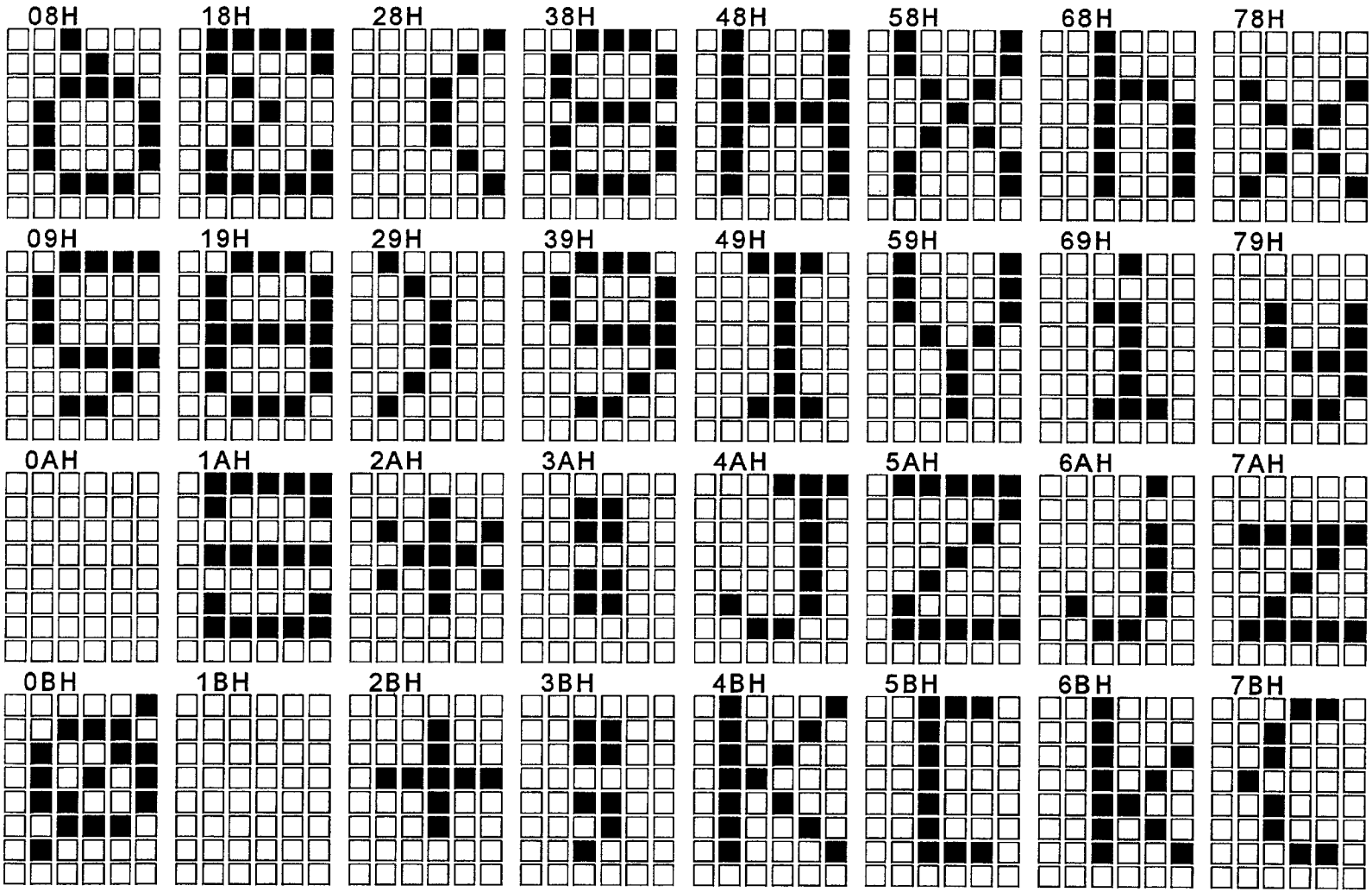
Figure 8:
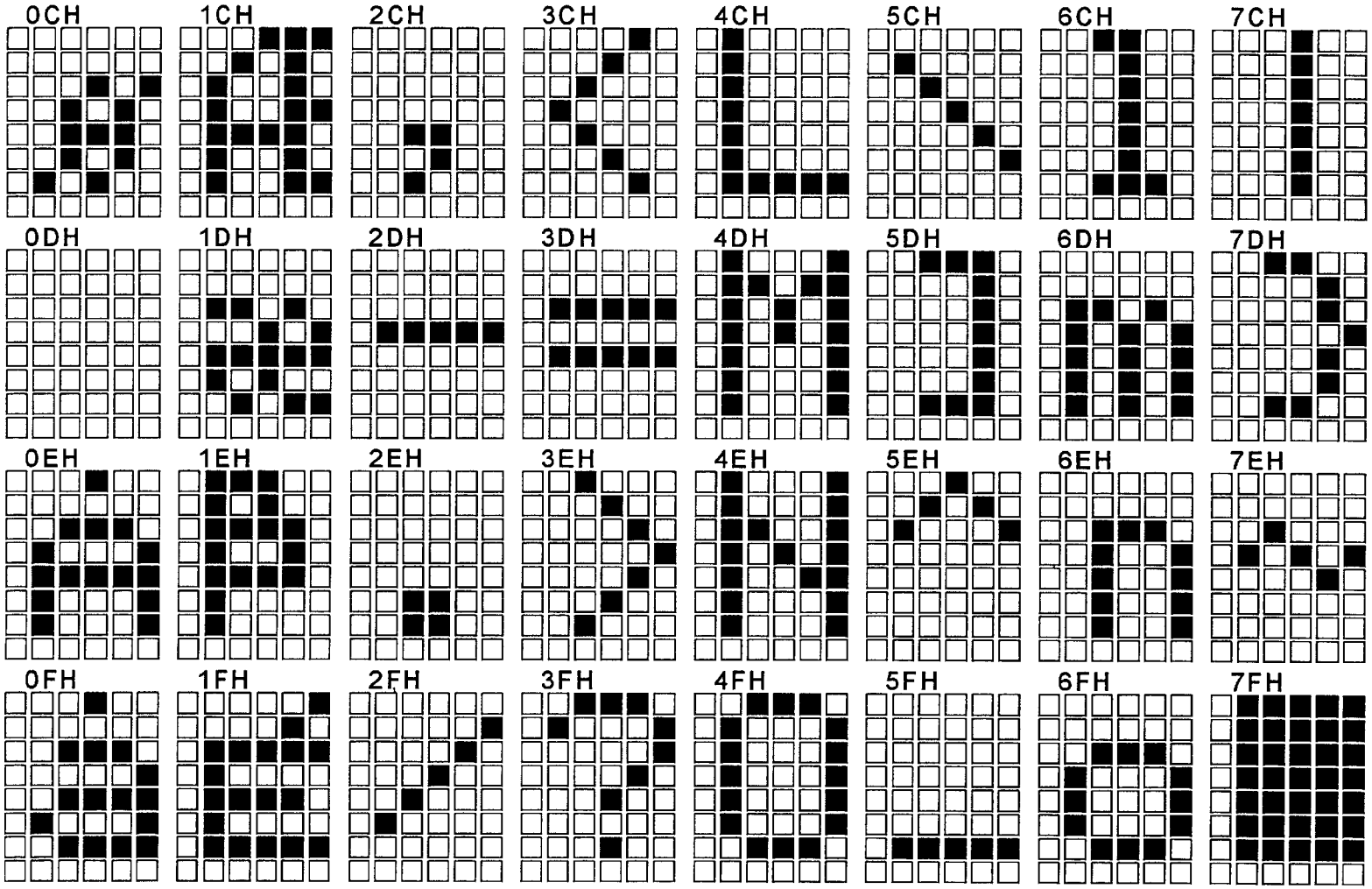
Figure 9:
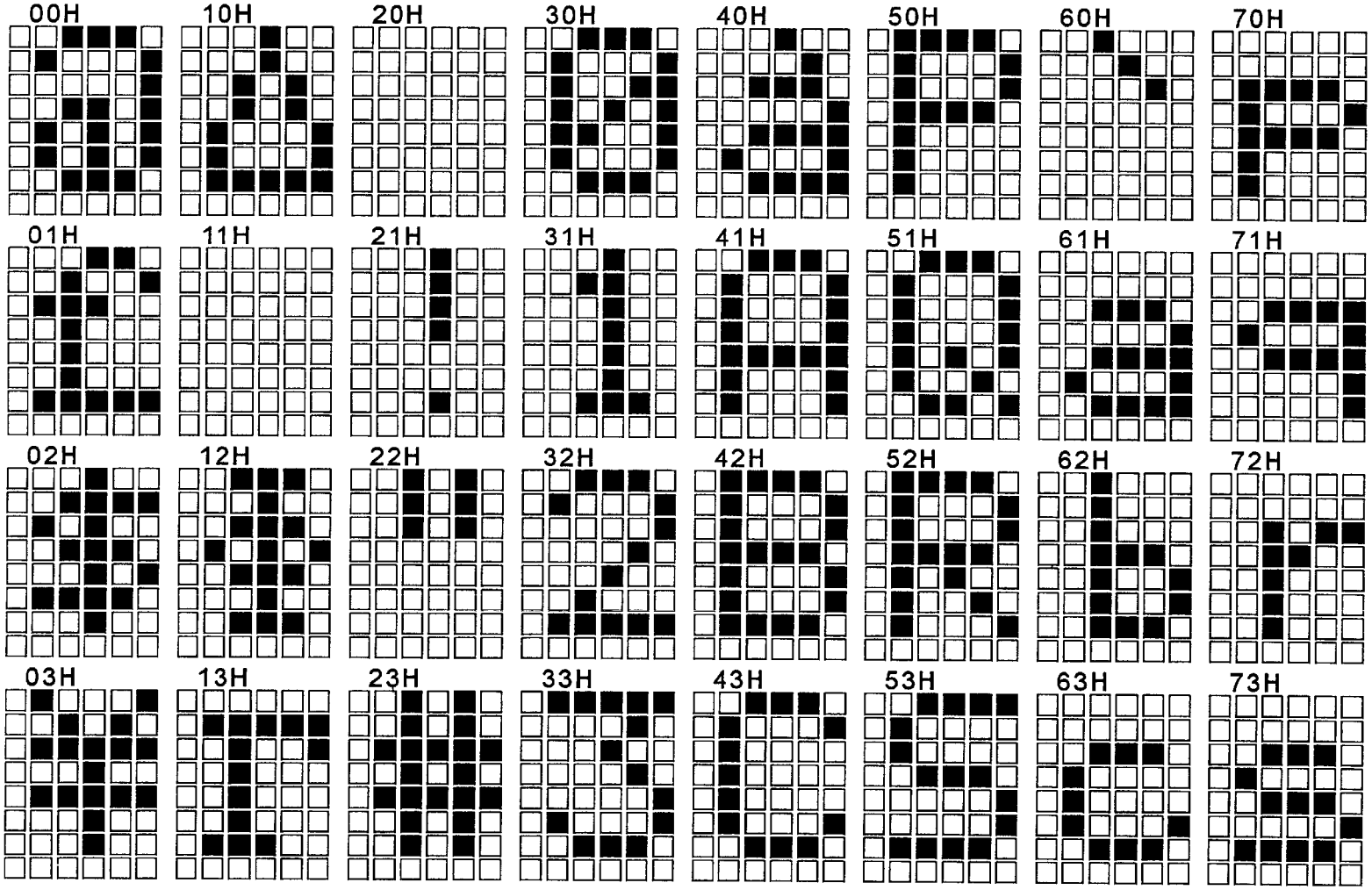
Figure 10:
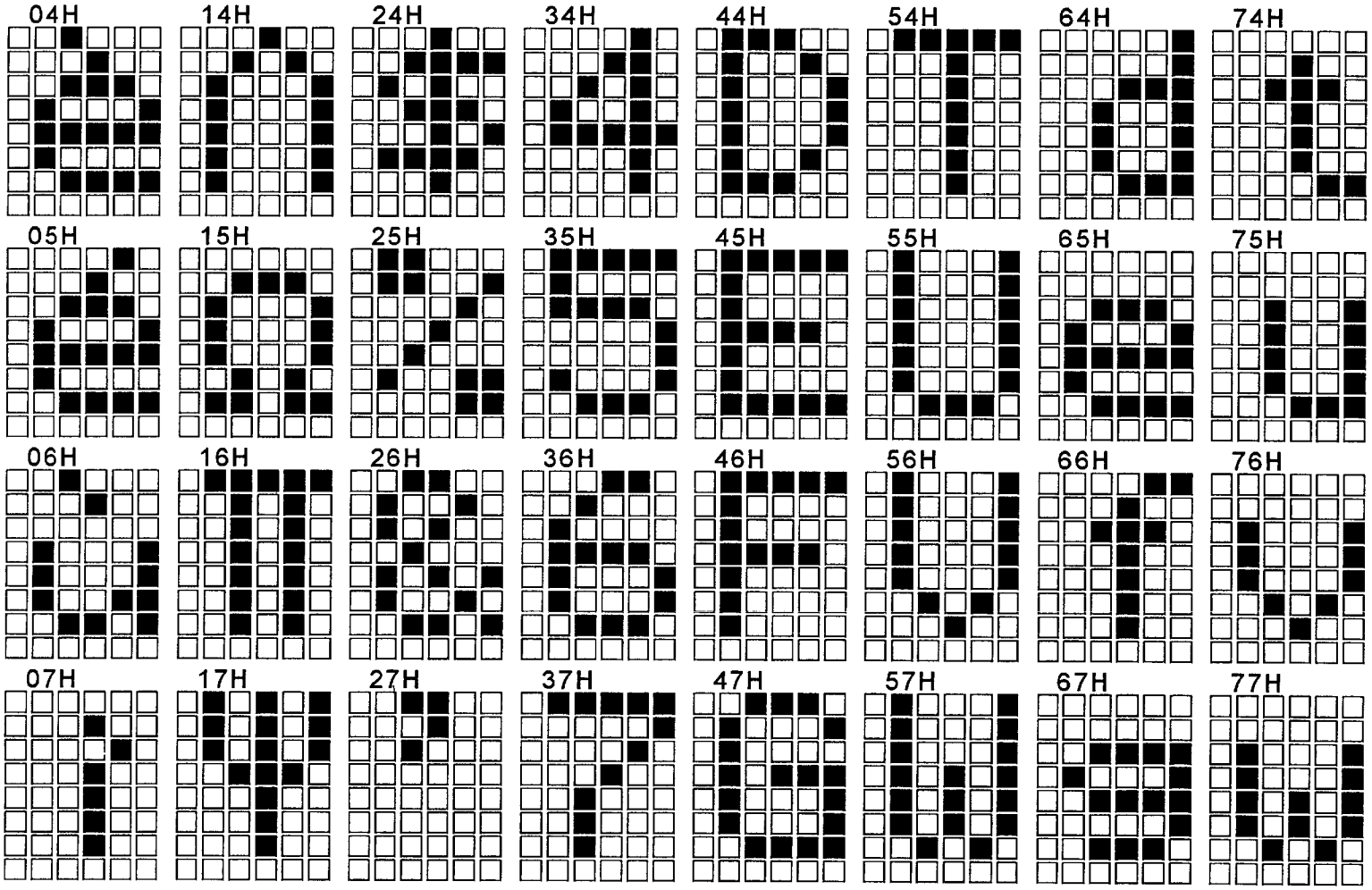
Figure 11:
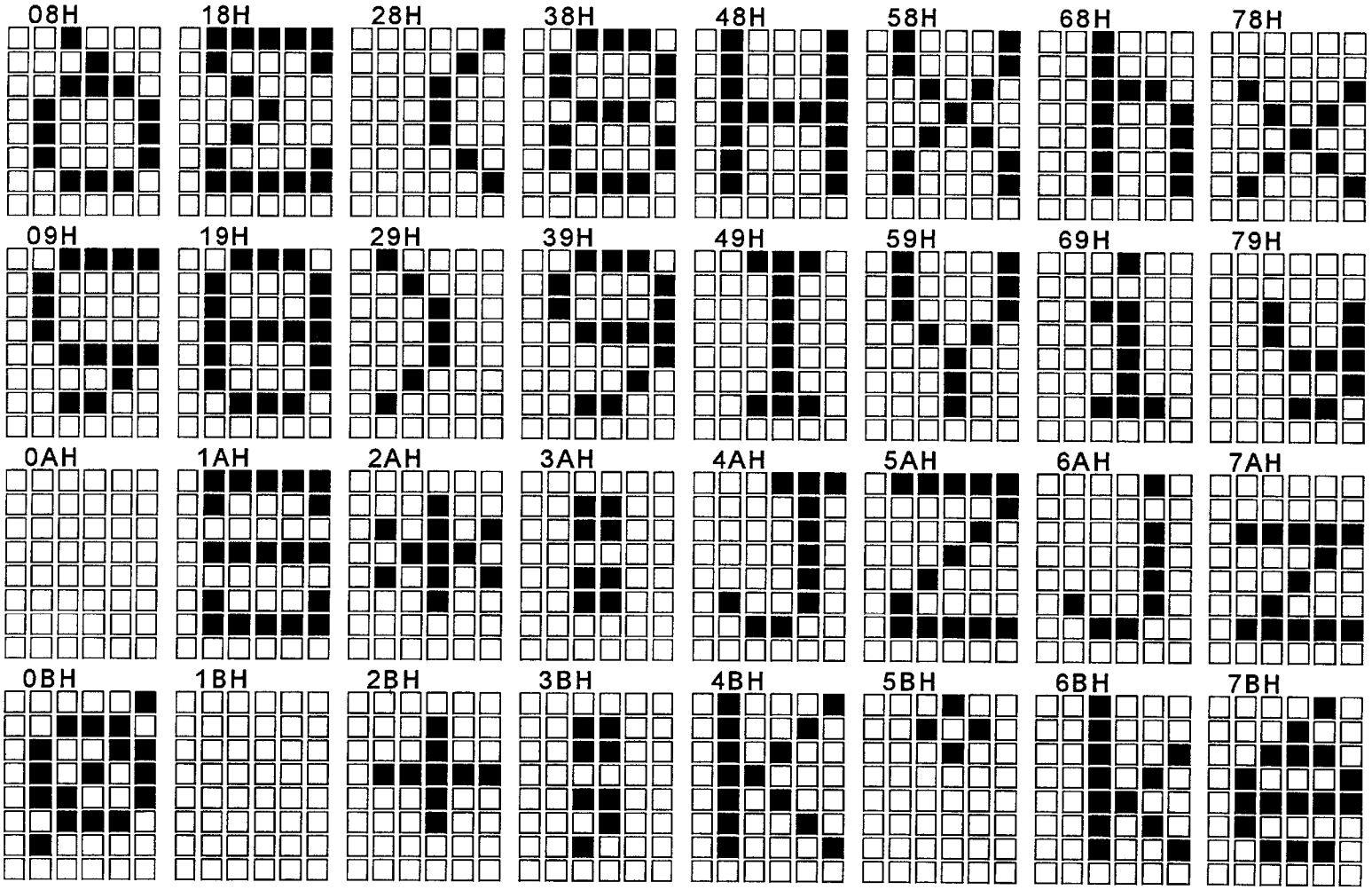
Figure 12:
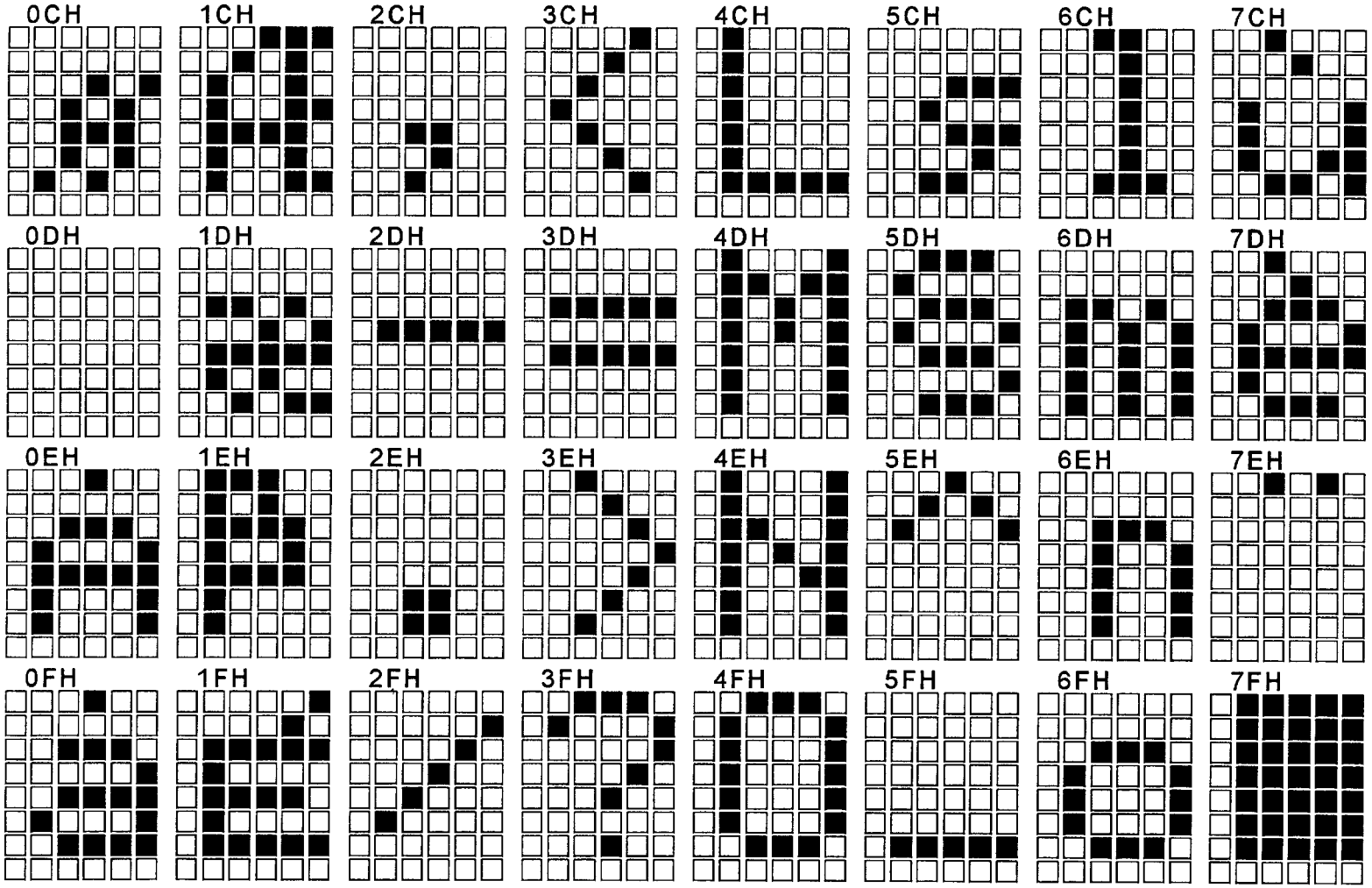
Figure 14:
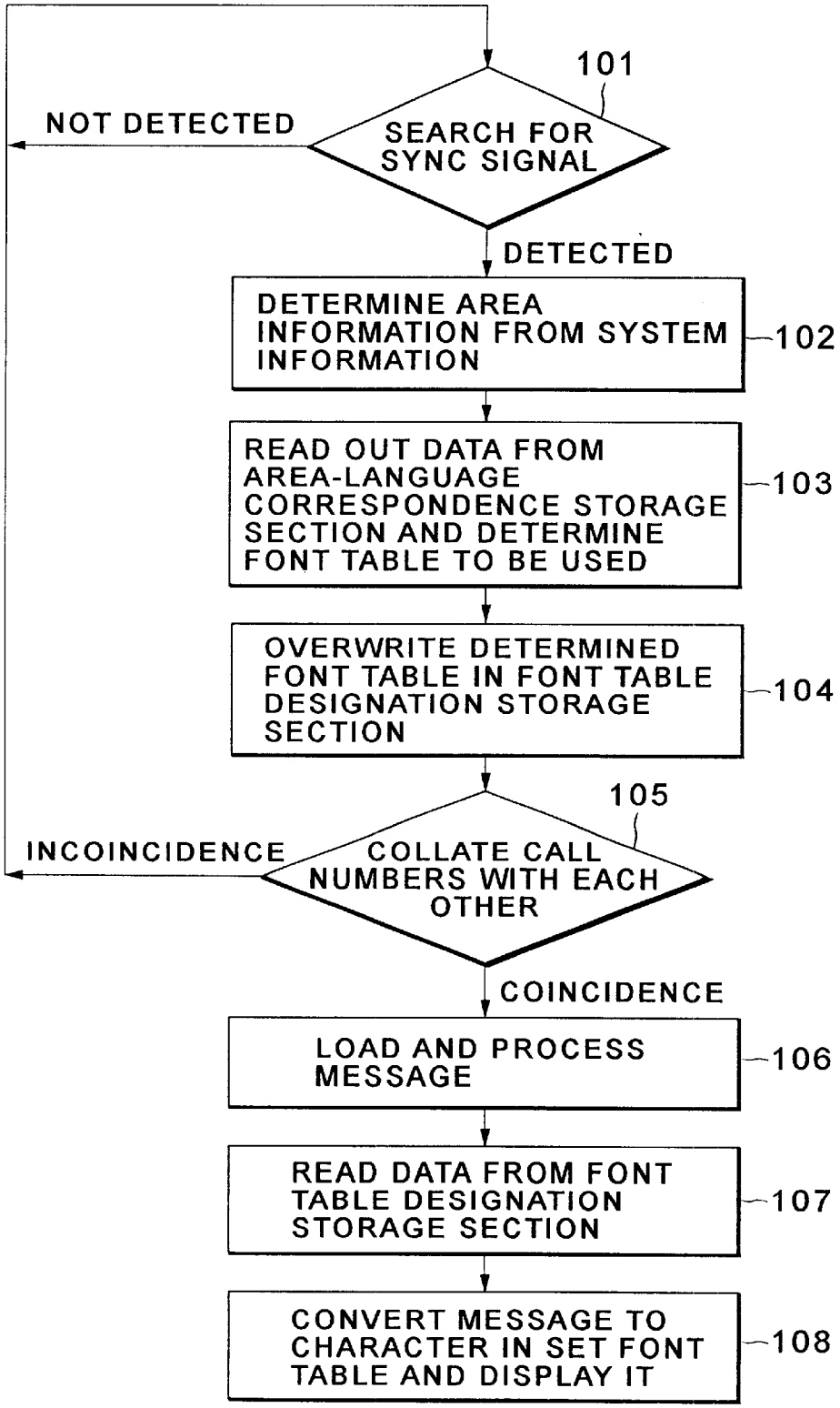
FIG. 14 is a flow chart showing the operation of the radio selective calling receiver in FIG. 2.
Figure 15:
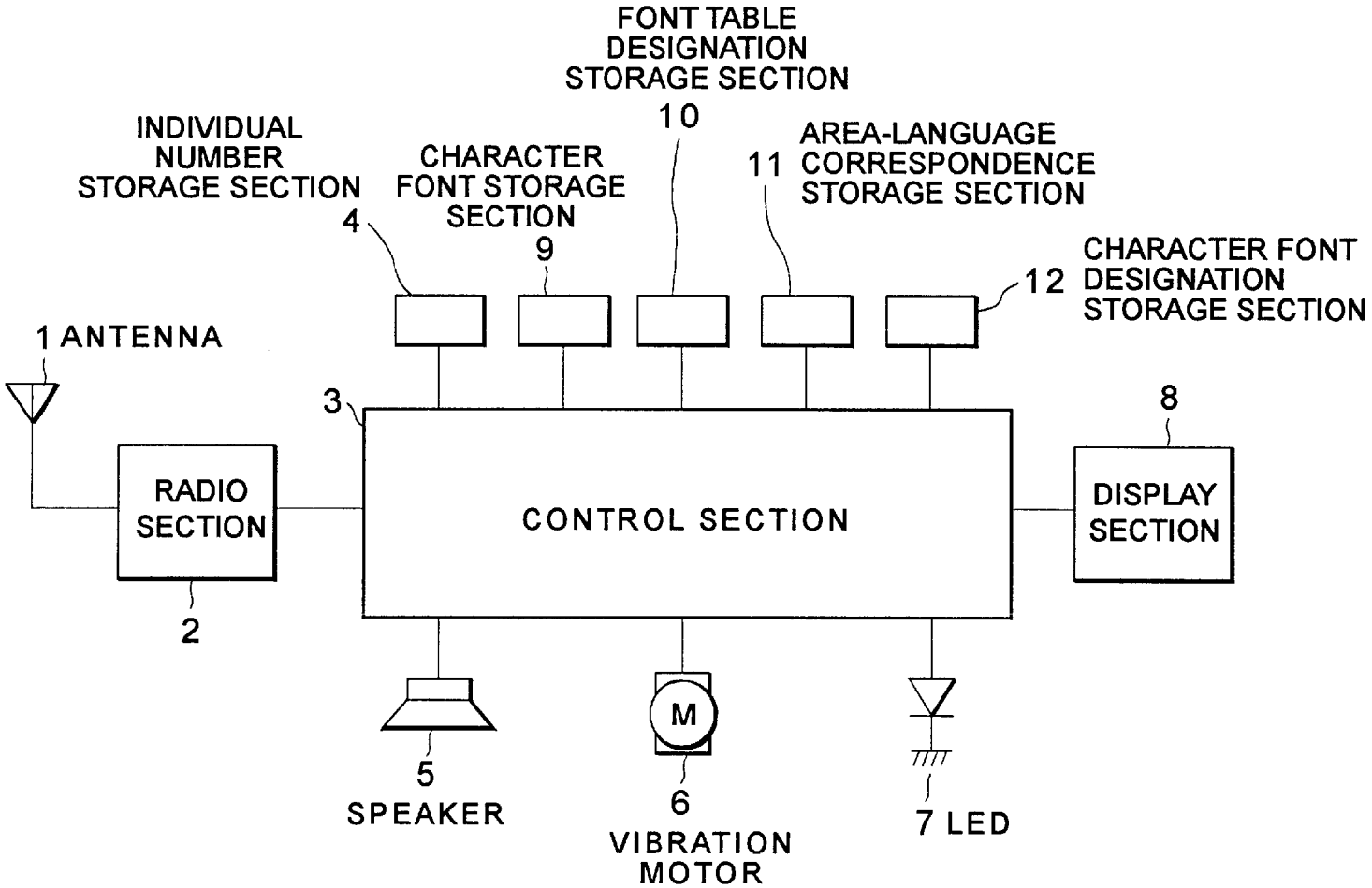
FIG. 15 is a block diagram showing the arrangement of a radio selective calling receiver according to another embodiment of the present invention.

The notification information changing capability is provided by several of the components herein incorporated in the paging receivers of FIGS. 2 and 15 operating in concert, including the character font storage 9, the font table designation storage 10, the arealanguage correspondence storage 11 as shown in detail in FIG. 13, and the character font display 8. FIGS. 3 and 4 illustrate a frame of a pager receiver signal, and FIGS. 5–12 illustrate different stored font tables. All of these components and features operate in concert in accordance with the operation flow charts of FIGS. 14 and 16, as explained in the corresponding detailed descriptions of those Figures and components in the specification herein.

Figure 1:
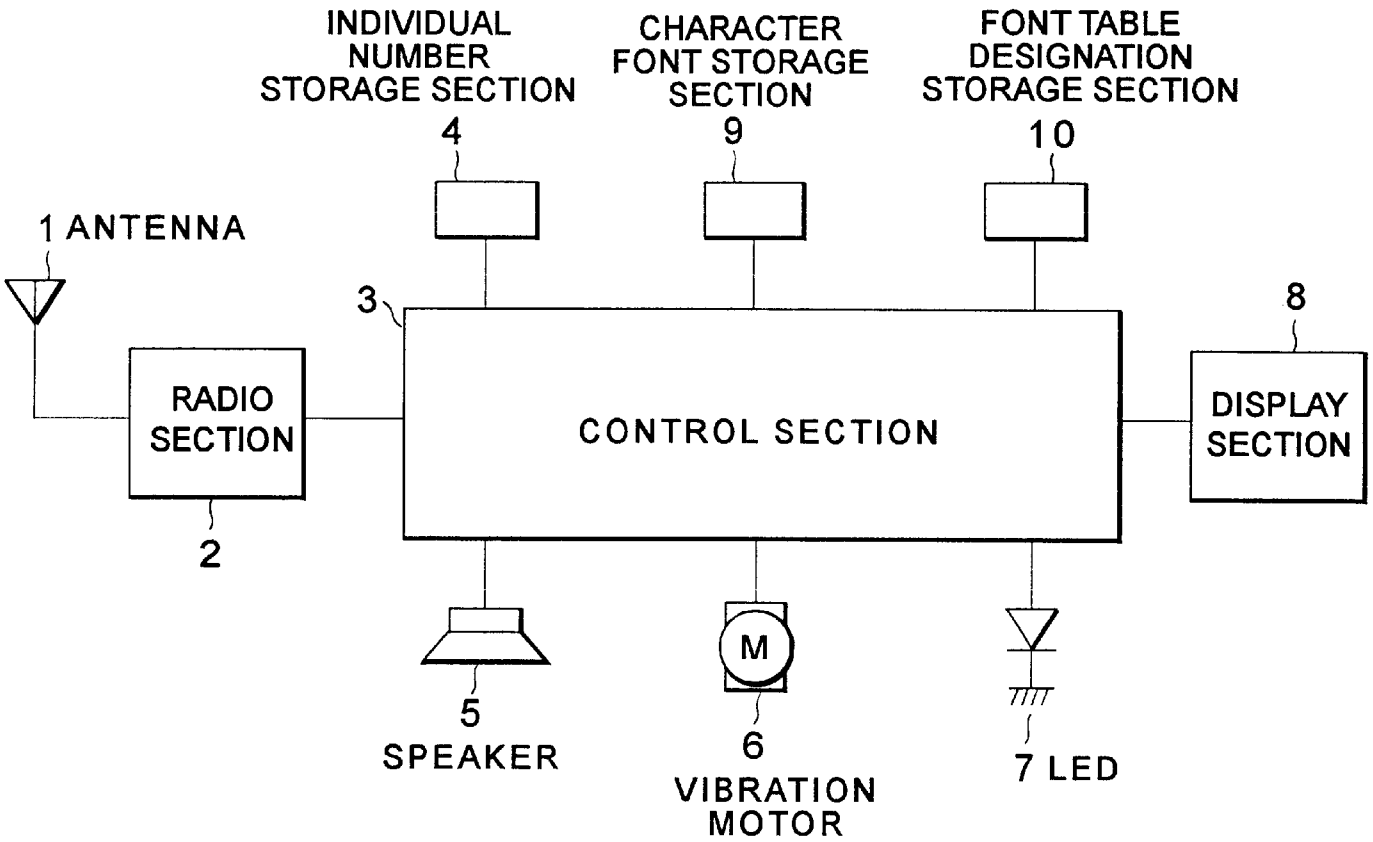
FIG. 1 PRIOR ART
FIG. 1 is a block diagram showing the arrangement of a conventional radio selective calling receiver.

Referring to FIG. 2, reference numeral 1 denotes an antenna; 2, a radio section; 3, a control section; 4, an individual number storage section; 5, a speaker; 6, a vibration motor; 7, an LED; 8, a display section; 9, a character font storage section; and 10, font table designation storage section. That is, this embodiment has the same arrangement as that of the prior art in FIG. 1.

Reference numeral 11 denotes an area-language correspondence storage section in which the correspondence between the pieces of area information in reception signals, languages, and font tables is stored.

FIG. 3 shows the format of a signal received by the radio selective calling receiver in FIG. 2. The reception signal is transmitted from a base station in units of frames. FIG. 3 shows the format of one frame of the signal.

As shown in FIG. 3, one frame of the reception signal is constituted by a preamble signal and a sync signal, which are used to synchronize the signal, a system information partition storing system information in a communication system for the radio selective calling receiver, a call number partition storing a call number assigned to an originating radio selective calling receiver, and a message partition storing a message to be sent to the user of the originating radio selective calling receiver.

In addition, the system information partition of the reception signal includes an area information partition storing area information.

FIG. 4 shows the format of the system information partition of the reception signal in FIG. 3.

As shown in FIG. 4, the system information partition is constituted by a communication management information partition storing information used for communication management, an area information partition storing area information indicating the area in which the radio selective calling receiver is currently present, and a supplementary information partition storing supplementary information such as the current date or the like.

In, for example, the ERMES (European Radio Message System) defined by the ETSI (European Telecommunications Standards Institute), since "Zone code" and "Country code" are set in "System Information Partition", a zone code and a country code can be used as area information. In the ERMES, a base station apparatus transmits information about an area where the base station apparatus itself covers as a zone code and a country code.

The ERMES is currently used in an European area where a plurality of languages are used. It is also expected that a new standard based on the ERMES will be used worldwide. In such a case, one radio calling receiver can be used in a wide area in the world. This makes the present invention, which can cope with a plurality of languages, more effective.

FIGS. 5 to 12 show the font tables stored in the character font storage section 9 in FIG. 2. Note that the font table shown in FIGS. 5 to 8 is used to display English messages, and the font table shown in FIGS. 9 to 12 is used to display French messages.

The font tables shown in FIGS. 5 to 12 are used when character fonts are stored in units of dots. However, the present invention is not limited to this. For example, the present invention can be applied to a case wherein character fonts are stored in units of vectors or in other forms.

In the font tables in FIGS. 5 to 12, character codes and character fonts are stored in correspondence with each other. For example, "00H" is a character code, which indicates "00" in hexadecimal. Each character font is expressed by □ and ■. "□" and "■" are stored in the respective bits of the memory as "0" and "1". The shape of a character is expressed by ■. For example, the character code "41H" corresponds to the character font "A".

In this case, only the English and French font tables are shown, but the character font storage section 9 may store font tables for other languages such as German, Russian, and Spanish.

FIG. 13 shows a table stored in the area-language correspondence storage section 11, which indicates an example of the correspondence between pieces of area information, languages, and font tables.

In this case, the area information "01" indicates the U.S.A, the language to be used is English, and the font table "01" is used. The area information "02" indicates France, and the language to be used is French. In this case, the font table "02" is used.

"01" and "02" in the font table column in FIG. 13 are called font table codes, which correspond to font tables stored in the character font storage section 9. That is, the character font storage section 9 stores the correspondence between the font tables and the font table codes as well as the font tables shown in FIGS. 5 to 12. Assume that the font table code "01" is made to correspond to the font table shown in FIGS. 5 to 8, and the font table code "02" is made to correspond to the font table shown in FIGS. 9 to 12.

For example, as shown in FIG. 3, when the area information "04" is stored in the area information partition of the reception signal, the control section 3 shown in FIG. 2 can obtain the font table code "01" in accordance with the table stored in the area-language correspondence storage section 11 and shown in FIG. 13, and stores this font table code "01" in the font table designation storage section 10. When a message is to be displayed on the display section 8 in FIG. 2, the character font in the font table corresponding to the font table code stored in the font table designation storage section 10 is read out from the character font storage section 9. If, therefore, the font table code is "01", the font table shown in FIGS. 5 to 8 is used.

The operation of an embodiment of the present invention shown in FIG. 14 will be described next.

In step 101, the control section 3 decodes a demodulated signal and searches for a sync signal. Upon detection of the sync signal, the control section 3 checks the area information in the system information in step 102. In step 103, the control section 3 determines a font table for a language used for display from the area-language correspondence storage section 11. In step 104, the control section 3 writes the font table code of the font table for the language determined in step 104 in the font table designation storage section 10.

In step 105, the control section 3 detects a call number. If the number coincides with the individual information written in the individual number storage section 4, the control section 3 loads a message and processes it in step 106.

In step 107, the control section 3 reads out the information from the font table designation storage section 10 to recognize the set font table. The processed message is converted by using the font table corresponding to the font table code read in step 107. In step 108, the message is displayed on the display section 8.

Another embodiment of the present invention will be described next with reference to the accompanying drawings. FIG. 15 is a block diagram showing the arrangement of another embodiment of the present invention.

Referring to FIG. 15, reference numeral 1 denotes an antenna; 2, a radio section; 3, a control section; 4, an individual number storage section; 5, a speaker; 6, a vibration motor; 7, an LED; 8, a display section; 9, a character font storage section; 10, a font table designation storage section; and 11, an area-language correspondence storage section, in which the correspondence between the pieces of area information in reception signals, languages, and font tables is stored.

Reference numeral 12 denotes a character font designation storage section 12. The arrangement of this embodiment is the same as that shown in FIG. 12 except for this character font designation storage section 12.

The user of the receiver can arbitrarily set the receiver such that a font table used for display is fixed or the receiver automatically switches font tables in accordance with received area information, and stores the set state in the character font designation storage section 12.

Figure 16:
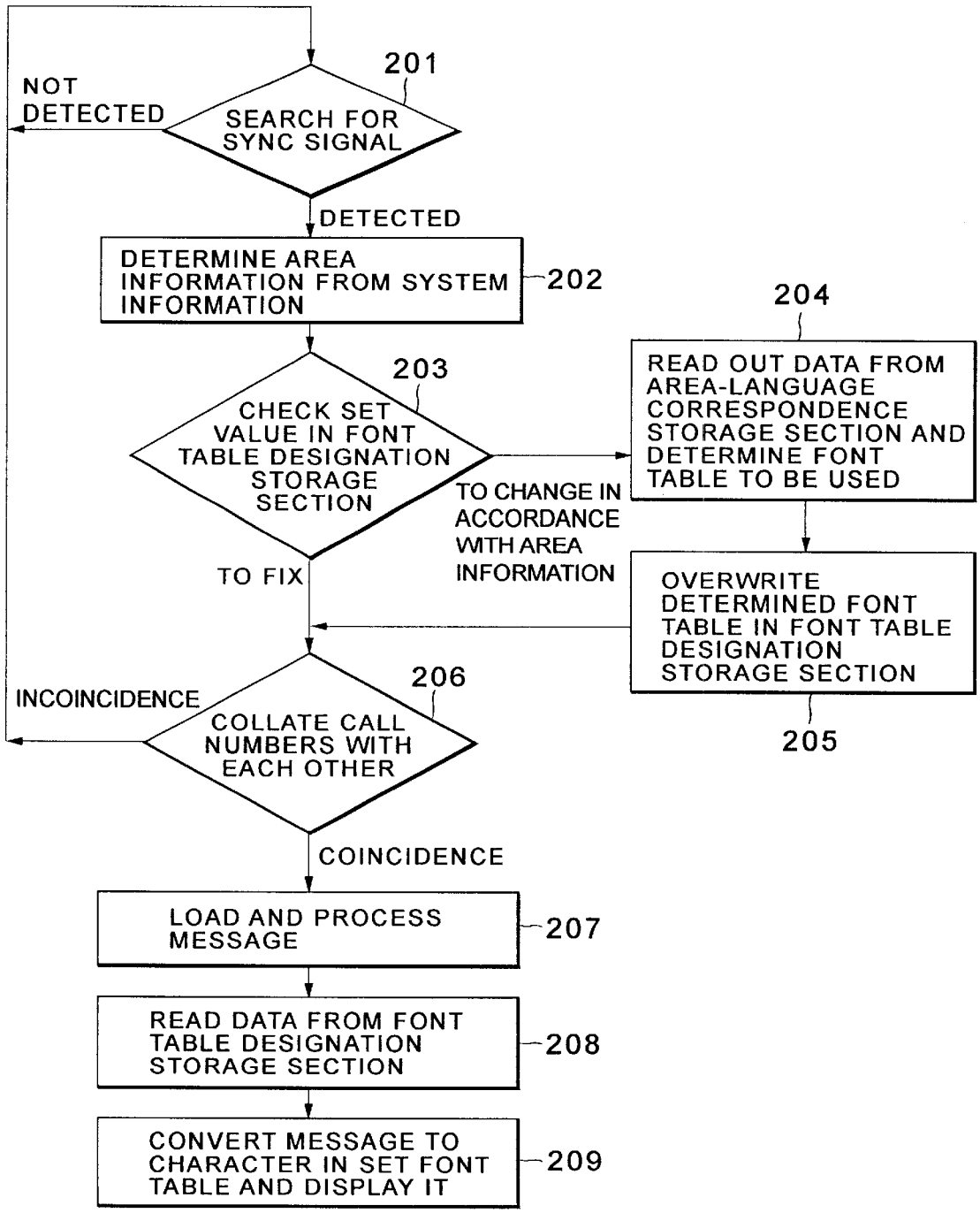
FIG. 16 is a flow chart showing the operation of the radio selective calling receiver in FIG. 15.

FIG. 16 is a flow chart showing the operation of this embodiment.

In step 201, the control section 3 decodes a demodulated signal and searches for a sync signal.

Upon detection of the sync signal, the control section 3 checks the area information in system information in step 202. The control section 3 determines "04" in the signal shown in FIG. 3.

In step 203, the control section 3 checks whether the font table designation set in the character font designation storage section 12 is "to fix" or "to change in accordance with area information".

If "to change in accordance with area information" is set, the control section 3 reads out data from the area-language correspondence storage section 11 and checks the language corresponding to the area information in the currently received signal in step 204. In step 205, the control section 3 overwrites, in the font table designation storage section 10, the font table code "01" corresponding to the checked language.

If the control section 3 detects a call number from the received signal in step 206, and the call number coincides with the individual number written in the individual number storage section 4, the control section 3 loads and processes a message in step 207.

In step 208, the control section 3 reads out data from the font table designation storage section 10, and recognizes the current set font table code "01".

In step 209, the control section 3 converts the processed message into character font data by using the font table corresponding to the font table code "01", and displays it.

Applications and the like of the present invention will be described finally.

In a communication system using radio selective calling receivers, in order to increase the number of uses of radio selective calling receivers, various types of services may be offered to the users of radio selective calling receivers. For example, such services include allowing a user to receive weather forecast information at the current location, news information, and the like by using a radio selective calling receiver.

In this case, news information or the like is contained in the message partition of the reception signal for the radio selective calling receiver in FIG. 3 and transmitted from a base station that covers the current location. As is obvious, this message is provided in language used at the current location.

Assume that the character code "44H 7BH 70H 72H 6FH 74H 65H 63H 74H 69H 6FH 6EH 3FH" is stored in French in the message partition of the reception signal. In this case, according to the present invention, the receiver displays "Déprotection?" (this is a French word and is translated into "Unprotection?" in English), that is, a word that having a meaning is displayed, by referring to the area information partition of the reception signal and using the font table (FIGS. 9 to 12) corresponding to the font table code "02".

In the conventional radio selective calling receiver, however, the font table is not changed unless the user of the receiver switches the font tables. Assume that the English font table has been used. In this case, upon reception of a signal having the character code "44H 7BH 70H 72H 6FH 74H 65H 63H 74H 69H 6FH 6EH 3FH" stored in the message partition as in the above case, the conventional radio selective calling receiver uses the English font table (FIGS. 5 to 8) and displays "D{protection?", that is, a meaningless word is displayed on the display section 8.

In the above embodiments, the present invention is applied to the radio selective calling receivers. Obviously, however, the present invention is not limited to this and can be applied to portable devices such as a cellular phone and a portable information terminal.

The operations of the embodiments of the present invention have been described above. However, the present invention is not limited to the above embodiments. Various changes and modifications of the embodiments can be made within the spirit and scope of the invention.

As has been described above, according to the present invention, since the receiver itself automatically switches the languages to be used in accordance with a reception signal, a message can be displayed in language corresponding to the current location.

What is claimed is:

1. A radio selective calling receiver comprising:

current location determining means for determining a current location from a reception signal;

a character font storage section storing character fonts for a plurality of different nationality languages;

an area-language correspondence storage section for storing a correspondence between a plurality of different geographic areas and the plurality of different nationality languages;

character font selection means for selecting a character font for a particular nationality language corresponding to the current location on the basis of data stored in the area-language correspondence storage section; and display means for displaying a message in the particular nationality language of the current location by using the character font selected by the character font selecting means.

2. A receiver according to claim 1, wherein the current location determining means determines a current location by detecting area information from system information of a currently received signal.

3. A receiver according to any one of claims 1 and 2, wherein a user can arbitrarily set the character font selection means to use or not to use a selection function of the character font selection means.

4. An apparatus comprising a radio mobile selective call receiver having a reception means for receiving a reception radio signal, wherein the mobile radio selective call receiver determines the geographic location of the radio selective call receiver on the basis of information data contained in the reception radio signal, and notification information changing means for changing information to be displayed by the radio selective call receiver to a user on the basis of information of the geographical location contained in the reception radio signal received by the reception means.

5. An apparatus according to claim 4, wherein the reception signal received by the reception means contains area information indicating an area corresponding to a current location and a message, and the notification information changing means changes a language to be used to notify the user of the message to a language used in the area corresponding to the current location on the basis of the area information.

6. An apparatus according to claim 5, wherein the notification information changing means includes display means for displaying the message, and causes the display means to display the message by using a character font for a language used at the current location.

7. A notification method comprising the steps of changing information to be displayed by a mobile radio selective call receiver, wherein the mobile radio selective call receiver determines the geographic location of the radio selective call receiver on the basis of information data location contained in a reception radio signal, and changes the information displayed by the radio selective call receiver to a user in accordance with information of the geographical location contained in the reception radio signal.

8. A method according to claim 7, further comprising the steps of:

receiving a reception signal containing area information indicating an area corresponding to a current location and message; and changing a language to be used to notify the user of the message to a language used in an area corresponding to a current location on the basis of the area information.

9. A message display method comprising the steps of:

receiving with a radio selective call receiver a reception signal containing area information indicating an area corresponding to a current geographic location of the radio selective call receiver and message; and changing a character font to be displayed by the radio selective call receiver to a character font of the nationality language of the current geographic location of the radio selective call receiver on the basis of the area information.

* * * * *